US008082997B2

(12) United States Patent
Webre et al.

(10) Patent No.: US 8,082,997 B2
(45) Date of Patent: Dec. 27, 2011

(54) MANIPULATABLE SPIDER COMPONENTS ADAPTED FOR COOPERATION WITH A VERTICALLY RECIPROCATING CONTROL LINE GUIDE

(75) Inventors: Charles Michael Webre, Lafayette, LA (US); Vernon Joseph Bouligny, New Iberia, LA (US); Brian David Begnaud, Youngsville, LA (US); Mark Stephen Sibille, Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 12/718,888

(22) Filed: Mar. 5, 2010

(65) Prior Publication Data

US 2010/0175893 A1 Jul. 15, 2010

Related U.S. Application Data

(63) Continuation of application No. 11/371,742, filed on Mar. 9, 2006, now Pat. No. 7,703,540, which is a continuation-in-part of application No. 10/995,907, filed on Nov. 24, 2004, now Pat. No. 7,216,716, which is a continuation-in-part of application No. 10/315,617, filed on Dec. 10, 2002, now Pat. No. 6,920,931, said application No. 11/371,742 is a continuation-in-part of application No. 10/995,905, filed on Nov. 24, 2004, now Pat. No. 7,222,677, which is a continuation-in-part of application No. 10/315,617, filed on Dec. 10, 2002, now Pat. No. 6,920,931.

(51) Int. Cl.
*E21B 19/22* (2006.01)

(52) U.S. Cl. ..... 166/379; 166/77.1

(58) Field of Classification Search ..... 166/379, 166/380, 385, 77.1, 77.51, 242.2
See application file for complete search history.

(56) References Cited

U.S. PATENT DOCUMENTS

| | | | | |
|---|---|---|---|---|
| 6,644,413 | B2 * | 11/2003 | Adams et al. | 166/382 |
| 6,889,772 | B2 * | 5/2005 | Buytaert et al. | 166/381 |
| 6,920,931 | B1 | 7/2005 | Webre et al. | |
| 7,703,540 | B2 * | 4/2010 | Webre et al. | 166/379 |
| 2005/0161230 | A1 * | 7/2005 | Webre et al. | 166/384 |
| 2006/0108122 | A1 * | 5/2006 | Buytaert et al. | 166/379 |
| 2010/0059231 | A1 | 3/2010 | Thomas et al. | |

FOREIGN PATENT DOCUMENTS

WO 2005003504 A2 1/2005

OTHER PUBLICATIONS

Office Action in EP Application No. 05 852 051.1-1266, dated Nov. 4, 2010 (10 pages).

* cited by examiner

*Primary Examiner* — William P Neuder
(74) *Attorney, Agent, or Firm* — Osha • Liang LLP

(57) ABSTRACT

A method and apparatus are provided for installing control lines and pipe into a well. The pipe-holding spider that is normally mounted on the rig floor is adapted for easy disassembly and reassembly when the pipe slips within the spider are not engaged with the outer surface of the pipe string so that upon disassembly, a control line guide becomes vertically movable. The control line guide is adapted for being controllably elevated to a distance above the rig floor, thereby providing personnel access to a portion of the length of the pipe string below the elevated control line guide and above the rig floor for securing control line to the pipe string using a fastener.

43 Claims, 7 Drawing Sheets

MANIPULATABLE SPIDER COMPONENTS ADAPTED FOR COOPERATION WITH A VERTICALLY RECIPROCATING CONTROL LINE GUIDE

CROSS-REFERENCE TO RELATED APPLICATIONS

The present application is a continuation of, and therefore claims benefit under 35 U.S.C. §120 to, U.S. patent application Ser. No. 11/371,742, filed on Mar. 9, 2006. Further, the present application is a continuation in part of, and therefore claims benefit under 35 U.S.C. §120 to, U.S. Pat. No. 7,216,716, filed on Nov. 24, 2004; U.S. Pat. No. 7,222,677, filed on Nov. 24, 2004; and U.S. Pat. No. 6,920,931, filed on Dec. 10, 2002.

BACKGROUND OF THE INVENTION

1. Field of the Invention

This invention involves an apparatus and method for installing pipe and control line in an earthen borehole. Specifically, this invention involves a spider having components that are adapted for being manipulated to facilitate securing of control line to a pipe string as it is being made up and run into a borehole.

2. Background of the Invention and Related Art

Oil and gas wells may be equipped with control lines for mechanically, electrically, pneumatically, hydraulically or optically linking various downhole devices to the surface. Control lines may be used to receive data from downhole instruments or to operate downhole devices such as valves, switches, sensors, relays or other devices. Control lines may be used to open, close or adjust downhole valves in order to selectively produce or isolate formations at locations deep in the well. A control line may transmit data gathered downhole to the surface or communicate commands to downhole devices to take samples, readings, or to stroke valves. Control lines may comprise electrically conductive wires or cables, optical fibers, or fluid conduits for pneumatically or hydraulically controlling downhole devices or transmitting data.

Control lines are generally of a small diameter relative to the diameter of the pipe string to which they are secured, and are generally between 0.5 and 6 cm in diameter. A plurality of control lines may be aggregated to form an umbilical having a diameter of up to 10 cm or more. Control lines are generally secured along the length of the outer surface of a pipe string, generally parallel to the center axis of the bore of the pipe string. Continuous control lines are secured to the pipe string and installed in the well as joints of pipe are made up into a pipe string and run into a well.

Control lines secured to pipe string are subject to being damaged and being rendered useless if they are pinched or crushed by the pipe slips used to grip and support the pipe string while it is being made up and run into the well. This presents a challenge in securing the control lines to the pipe string as it is made up and run into the borehole. Depending on the diameter, length and pipe thickness, the pipe string may weigh more than four hundred thousand pounds. A pipe-gripping tool called a spider is required to grip and support the pipe string at or near the rig floor. The spider generally comprises a tapered bowl having a bore with an axis that is generally aligned with the borehole. The pipe string passes through the tapered bowl, and the tapered bowl receives a generally circumferential arrangement of radially inwardly movable slips that surround and engage the pipe string within the tapered bowl. The generally wedge-shaped slips are adapted for engaging the outer curved surface of the pipe string and bearing against the tapered inner surface of the bowl to provide generally radially distributed support in a self-tightening manner.

It is important that the pipe slips in the spider generally uniformly grip and support the pipe string in order to minimize localized stress and loads on the pipe that may crush or damage the pipe string. The radially inwardly disposed gripping surfaces of the slips are concave in order to contact the pipe over a radially large area to minimize localized stresses. When control lines are being secured to the pipe and run into the borehole, it is important to prevent the control lines from being pinched or trapped between the spider slips and the outer surface of the pipe string, or between adjacent slips as they move radially inwardly to grip and support the pipe string. If a control line is trapped between the slips and the pipe string or between two adjacent slips, the control line may be damaged with a resulting loss or impairment of surface control of, or communication with, downhole devices or instruments that are linked to other devices or to the surface using control line(s). It is important that control lines be secured to the pipe string in a manner that will prevent control line damage.

One method of installing control lines involves extending the control lines along the portion of the pipe string that is gripped and supported within the tapered bowl of the spider. A control line may be aligned and positioned along the length of the exterior surface of the pipe string to radially coincide with and pass through a gap or recess between adjacent slips. This method may be unsatisfactory where multiple control lines are being secured to the pipe string because more of the circumference of the pipe string is required to accommodate the control lines, leaving less contact circumference for the slips to engage and support the pipe string.

The growing appreciation for the advantages and benefits of controllable downhole tools and devices and for receiving data from downhole instruments has resulted in the development of new tools and methods for installing control lines in a well. One approach involves the use of a table-elevated spider constructed on the rig floor to support the spider and the pipe string, thereby creating and maintaining a clamping zone between the table and the rig floor. This "clamping zone" provides access to a portion of the pipe string beneath the spider for introducing and securing control lines along the length of the pipe string. The control lines are fed to the pipe string at a location underneath the table that supports the spider, secured to the pipe string, and then fed into the borehole along with the pipe string as it is made up and lowered into the borehole. While the table-elevated spider prevents slip damage to control lines at the spider, the legs supporting the table must be strong enough to support the entire pipe string, the spider, and the table, which is a work platform for machines and personnel. The required strength of the legs and the space restrictions of the table present significant expense and safety concerns.

Another approach to securing control lines to a pipe string as it is being made up and run into a well involves a spider adapted for being received in a retainer that can be vertically reciprocated from and to its retracted position within or near the floor of the rig. This invention eliminates the need for an elevated table with legs strong enough to support the spider, table and pipe string. After the weight of the pipe string is transferred to the elevator, the retainer and spider are raised from the floor position to create a temporary clamping zone between the raised spider and the rig floor. The control line may be directed over roller guides or sheaves secured on or adjacent to the retainer that supports the spider so that the control line will conveniently align along the exterior length of the pipe string within the temporary clamping zone. After the control line is secured to the pipe string in the clamping zone, the pipe string and the control line are lowered into the borehole and the retainer and the spider are returned to their original position in or near the rig floor for again receiving and supporting the pipe string while an additional pipe segment is made up into the pipe string.

While vertically reciprocating the spider in this manner eliminates the expense and safety concerns associated with the table-elevated spider, there remains a need to optimize the equipment and the methods for securing control line to a pipe string. What is needed is a method of securing a control line to a pipe string that does not require the repeated movement of the entire spider to establish a clamping zone. What is needed is an apparatus that permits the repeated movement of select components of the spider in order to create a clamping zone for securing control line to the pipe string.

SUMMARY OF THE INVENTION

The present invention utilizes a spider having slips for being received within a tapered bowl of the spider, and a vertically reciprocating control line guide for engaging and then imparting a desired configuration or pathway to a control line. The control line guide rollably or slidably engages a control line, and moves between a retracted position and a raised position. The control line guide remains in a retracted position when the spider engages and supports the pipe string. The retracted position of the control line guide is characterized as having at least a portion of the control line guide beneath the top surface of the tapered bowl of the spider. When the control line guide is in its retracted position, the lowermost point on the control line guide, or the "exit," is positioned below the bottom of the slips and adjacent to the pipe string. The raised position of the control line guide is characterized as having the control line guide sufficiently raised above the top surface of the tapered bowl of the spider to provide a clamping zone in which the control line is positioned along at least a portion of the pipe string between the raised control line guide and the rig floor. The clamping zone provides access to the portion of the pipe string and the control line for application of a clamp or fastener for securing the control line to the pipe string.

The spider is adapted for repeated manipulation or removal of one or more components of the spider to create an unobstructed pathway for raising the control line guide from its retracted position to its raised position. In one embodiment, the slips are the spider component that are adapted for being repeatedly unseated from their engaged position within the tapered bowl of the spider and removed from the tapered bowl at least to an extent sufficient to clear a pathway for the control line guide to elevate along a portion of the length of the pipe string near the spider. In this embodiment, the spider may comprise a tapered bowl and a set of three slips that includes a center, manipulated slip and two following slips, each hinged or movably coupled to the manipulated slip. The slips surround, engage and support the pipe string when received in their engaged position within the tapered bowl of the spider. The tapered bowl comprises a slot in which the control line guide moves between its retracted and raised positions. The slot may be positioned to coincide with a gap between adjacent following slips when the set of slips is engaged with the pipe string within the tapered bowl. Optionally, the slot may be positioned generally opposite the manipulated slip, which will generally align the slot between the adjacent following slips. The slips may be upset from their engaged position by application of a lifting force to the manipulated slip, primarily in a vertical direction at first, and the set of slips may be completely or just partially removed from the engaged position within the tapered bowl to clear a pathway above the slot to permit raising of the control line guide.

The control line guide may be raised to create a clamping zone when the weight of the pipe string is supported by the elevator and the set of slips are sufficiently removed from their engaged position to clear a pathway for raising the control line guide. The control line guide may be coupled to a jack or to a winch for vertically raising the control line guide above the slot to create a clamping zone. In one embodiment, the slot in the spider may be closable using a plug-in door adapted for being generally vertically received within the slot in an interlocking fashion so that the plug-in door provides added load bearing capacity to the tapered bowl. In one embodiment, the plug-in door may be secured to the same jack that raises and lowers the control line guide. In this embodiment, after the control line guide and the plug-in door are raised to create a clamping zone and the control line is secured to the pipe string, the pipe string and the control line may be lowered into the borehole, and the control line guide and the plug-in door may then be lowered to their retracted and engaged positions, respectively. The slips are then restored to their set position within the tapered bowl to engage and support the pipe string while another pipe segment is threadably coupled to the proximal end of the pipe string. The plug-in door may be interlockably received into a slot that is positioned above a "half door" that resembles a conventional side door of a spider, but occupies only a portion of the full vertical height of the spider. The control line guide may penetrate the wall of the spider between the half door and the plug-in door when in its retracted position so that it may be raised along with the plug-in door to create a clamping zone without opening of the half door.

In another embodiment, the tapered bowl of the spider is adapted for removal from its aligned position with the borehole to clear a pathway for raising a control line guide. In this embodiment, the slips are adapted for being upset from their engaged position within the tapered bowl of the spider, but not necessarily for being completely removed from the tapered bowl. Instead, the tapered bowl comprises a generally vertical slot that allows the tapered bowl to be laterally moved to a remote position away from its aligned position with the borehole when the weight of the pipe string is supported by the elevator. The slot in the tapered bowl of the spider may be closable by a conventional door having interdigitated hinges or by a plug-in door that is generally vertically received in an interlocking fashion to close the slot of the tapered bowl and raised from its seated position to open the slot of the tapered bowl. Opening of the slot of the tapered bowl using a plug-in door or a conventional door, or both, provides for lateral movement of the tapered bowl away from its aligned position with the borehole to clear a pathway for the control line guide. The generally horizontal movement of the tapered bowl and slips to the remote position clears the pathway of the control line guide to allow the control line guide to be raised to create a clamping zone above the rig floor and below the raised control line guide.

After the control line is secured to the pipe string at one or more locations within the clamping zone, the pipe string and control line may be lowered into the borehole and the control line guide may be restored to its retracted position. The tapered bowl is laterally restored to its position aligned with the borehole so that it generally surrounds the pipe string, the door is repositioned to close the tapered bowl, and the slips are received within the tapered bowl to engage and support the pipe string.

In another embodiment of the present invention, the tapered bowl comprises a slot for permitting vertical reciprocation of the control line guide, and the slips are adapted for being secured to a jack and vertically raised from the tapered bowl by raising the jack. A slot in the tapered bowl may permit the spider to be received around and removed from the pipe string. The door for closing the slot in the tapered bowl may be a half door of the conventional interdigitated hinged type or it may be a slidably received plug-in door, or a combination of the two. The slips may be vertically reciprocated using the jack toward and away from the tapered bowl. Slips and/or the plug in door may be reciprocated using the same jack that reciprocates the control line guide through the pathway cleared by removal of the plug-in door. After the weight of the pipe string is transferred to the elevator, the jack is moved into position to engage the slips and the plug-in door. The plug-in door may be coupled to the control line guide so that coupling the jack to the plug-in door also couples the jack to the control line guide. Upon raising the jack, the slips, plug-in door and the control line guide are vertically moved from their positions within the tapered bowl to create a clamping zone between the control line guide and the tapered bowl. After the control line is secured to the pipe string at one or more locations within the clamping zone, the pipe string and the control line are lowered into the borehole, the control line guide and the plug-in door are restored to their retracted positions with at least a portion of the control line guide being beneath the top surface of the tapered bowl, and the slips are received within the tapered bowl to engage and support the weight of the pipe string.

In another embodiment of the present invention, the slot in the tapered bowl is openable to allow the tapered bowl to be laterally removed from its position aligned with the borehole when the weight of the pipe string is supported by the elevator. The slips may remain within the tapered bowl as it is laterally removed from its aligned position with the borehole, or the slips may be securable to a jack that raises the slips to a raised position generally above the tapered bowl before the tapered bowl is moved, and also lowers the slips toward their engaged position within the tapered bowl when the tapered bowl is restored to its aligned position with the borehole. Similarly, the control line guide may be secured to a plug-in door, and the plug-in door may be in turn secured to a jack that raises the control line guide and the plug-in door to a raised position to create a clamping zone between the control line guide and the rig floor. The slips may be secured to the same jack that raises the control line guide and the plug-in door so that the slips are vertically raised away from their engaged position within the tapered bowl as the control line guide is raised to create a clamping zone.

After the control line is secured to the pipe string at one or more locations within the clamping zone, the pipe string and the control line may be lowered into the borehole and the tapered bowl may be restored to its aligned position with the borehole. Once the tapered bowl is restored to its aligned position with the borehole, the control line guide, plug-in door and slips may be lowered by the jack so that the control line guide can be received into its retracted position with at least a portion of the control line guide being beneath the top surface of the tapered bowl, the plug-in door may be vertically slidably received into the slot to strengthen the tapered bowl for supporting the pipe string, and the slips may be received in the tapered bowl to engage and support the pipe string.

In certain embodiments of the present invention, the tapered bowl of the spider is adapted for slidably receiving and surrendering a plug-in door to complete and strengthen the tapered bowl. Unlike the more conventional side door that couples to the tapered bowl with pins inserted through interdigitated hinges disposed on each end of the door, a plug-in door may be vertically slidably received in an interlocking fashion within a slot in the side of the tapered bowl. The plug-in door may comprise a door with a pair of generally vertical and downwardly disposed elongated posts, each coupled at their top end to a support plate and each receivable into a receptacle or port in the tapered bowl. Another type of plug-in door comprises a pair of outwardly disposed opposing T-shaped keys adapted for being vertically slidably received into mating T-shaped slots disposed on either side of the slot of the tapered bowl into which the plug-in door seats.

The control line guide which, depending on the embodiment, may or may not be coupled to a plug-in door, may be shaped to impart a desired pathway to a portion of the control line that is received thereon. The control line guide is adapted to gradually bend and redirect a portion of the control line into position adjacent to and along the portion of the pipe string that extends from below the raised control line guide and into the borehole. The control line approaches the control line guide from a position radially outwardly from the pipe string. Sheaves, rollers or guides may be used to strategically position and direct the control line to the receiving portion of the control line guide. The control line guide may be shaped or adjustable for accommodating differing control line sizes or approach angles depending on the configuration of the rig, but generally it is preferred to have the control line approach the control line guide from a position lateral to and above the control line guide in order to prevent tripping hazards or obstacles to movement by personnel working on the rig floor around the spider.

A control line guide usable for each of the above-referenced embodiments is adapted for slidably or rollably contacting a portion of the control line that is reeved through the control line guide. The pathway imposed by the control line guide on the control line is contoured to prevent unwanted kinking or excessive localized bending of the control line that might permanently impair the function or capacity of the control line. The control line guide may comprise a series of slides, rollers, guides or combinations of these, secured in a fixed or in an adjustable relationship one to the others. The control line guide may be adapted for continuous feed of a lubricant, coating or adhesive to the exterior jacket of the control line as it passes through or over the control line guide, and the control line guide may be adapted for accommodating instruments for inspection or testing of the control line as it passes through or over the control line guide.

In addition to raising and lowering the control line guide and other components, machines may also be adapted to manipulate components of the spider to clear a pathway for the vertical reciprocation of the control line guide. For example, after the weight of the pipe string is transferred to the elevator, the slips may be engaged and upset from their set position within the tapered bowl, and then partially lifted and partially removed from their aligned position with the borehole, all using a pneumatically or hydraulically-powered mechanism. A mechanical linkage may be coupled to a latching portion at or near the top of the manipulated slip to displace it initially upwardly and then radially outwardly away from the pipe string thereby causing the following slips to each rotate relative to the manipulated slip to clear the pathway for the vertically reciprocating control line guide. In some embodiments, this movement of the slips also allows passage through the tapered bowl of the clamp that secures the control line to the pipe string. Alternately, a mechanical linkage may be coupled to the manipulated slip to displace it initially upwardly and radially outwardly away from the pipe string to cause each of the following slips to rotate relative to the manipulated slip and to clear a pathway for the withdrawal of the pipe string from the tapered bowl with lateral movement of the tapered bowl away from its position aligned with the borehole. Depending on the embodiment of the invention used, the mechanism used to manipulate the slips may remove the slips completely from the tapered bowl or it may only partially remove the slips from their set position within tapered bowl, depending on the extent to which the slips must be moved. The extent of movement of the slips may be minimal for releasing the pipe string, more for reciprocation of the control line guide, and still more for providing clearance for the control line clamp to pass through the tapered bowl.

For the embodiments of the present invention adapted for removal of the tapered bowl to a remote position and restoration of the tapered bowl back to its position aligned with the borehole, a runway may be adapted for slidably or rollably receiving and supporting the tapered bowl as it moves laterally away from and then back to its position aligned with the pipe string. The runway acts as a support platform for the tapered bowl to facilitate movement to one or more remote positions to clear a pathway for reciprocation of the control line guide. The runway may be selectively radially positionable at two or more positions about the borehole, but is preferably aligned opposite the slot of the tapered bowl.

Machines may be adapted for movement of the tapered bowl, for opening or closing of the side door of the tapered bowl, and for removal or restoring the plug-in door to its position in the slot of the tapered bowl. For example, the embodiments requiring manipulation of the slips and the tapered bowl to clear a pathway for reciprocating the control line guide may require a first linkage for unseating the slips from their engaged position after the weight of the pipe string is transferred to the elevator. If the spider comprises a tapered bowl having a hinged side door, the door must be unlatched and opened to enable removal of the pipe string from the tapered bowl. A sliding latch mechanism may couple to the tapered bowl and move it along the runway adjacent to the borehole to its remote location. After the control line guide is raised to create a clamping zone and the control line is secured, the pipe string and the control line are lowered into the borehole, and the sliding latch mechanism may move the tapered bowl back along the runway to restore the tapered bowl to its position aligned with the borehole, and other mechanisms may restore the side door or plug-in door to close the slot in the tapered bowl, and also to restore the slips to engage and support the pipe string.

The mechanical linkage for moving the tapered bowl along the runway may cooperate with the control line guide such that a position sensor on the mechanical linkage enables the powered jack to begin raising the control line guide only after the tapered bowl reaches a certain distance from the pipe string. Similarly, a tapered bowl position sensor on the control line jack may enable the linkage to begin returning the tapered bowl along the runway towards its aligned position with the borehole when the control line guide has been lowered to a certain position or when it has been returned to its fully retracted position.

In the embodiments of the present invention adapted for vertical displacement of the slips, the slips may be raised using the same or a different jack that raises the control line guide and/or the plug-in door to a raised position. Because the initial movement of the slips from engagement is necessarily up and then radially outwardly away from the pipe string, a jack for raising the slips may be adapted for providing an initial upward unseating movement of the slips, followed by a raising of the slips and/or the control line guide. Similarly, a mechanical linkage may be adapted for providing lateral movement of the slips away from the pipe string. For example, in the embodiment adapted for lateral movement of the slips from the tapered bowl, the slips may be initially raised from their engaged position within the tapered bowl to a vertical position sufficient to clear the top surface of the tapered bowl, and then the slips may be moved radially outwardly away from their aligned position with the borehole.

In the embodiments adapted for removal of both the slips and the tapered bowl from their aligned positions with the borehole, the slips need only be unseated from their engaged position, and then raised to a substantially shorter vertical distance sufficient to disengage them from the pipe string and to permit the following slips to rotate slightly relative to the manipulated slip. This limited movement of the slips suffices to clear the pathway of the control line guide without necessarily displacing the slips to a position above the top surface of the tapered bowl.

In each embodiment of the present invention, after the control line guide is raised and the control line clamp installed to secure the control line to the pipe string, the pipe string and the control line may be lowered into the borehole as the control line is fed to the control line guide. The control line guide is retracted, the tapered bowl and the slips restored to their positions aligned with the borehole, the side door and/or plug-in door is restored to close the slot and strengthen the tapered bowl, and the slips are then disposed to their set position in the tapered bowl so that the weight of the pipe string can be transferred to the spider. After a new pipe segment is threadably coupled to the proximal end of the pipe string and torqued to a predetermined torque, the weight of the pipe string is transferred to the elevator and the process is repeated.

"Jack," as that term is used herein, includes but is not limited to jacks, winches, lifts and other powered devices for generally one-dimensional displacement of an object. A jack may be powered pneumatically, hydraulically, electrically or mechanically, and it may include a rotating screw drive, cylinder, scissor extension, track and pinion or other devices.

"Elevator," as that term is used herein, includes but is not limited to a side door elevator, an elevator comprising internal or external slips and all other devices used for gripping and supporting a pipe string from above the spider, including those supported by a top drive or draw works.

The terms "comprising," "including," and "having," as used in the claims and specification herein, shall indicate an open group that may include other elements not specified. The term "consisting essentially of," as used in the claims and specification herein, shall indicate a partially open group that may include other elements not specified, so long as those other elements do not materially alter the basic and novel characteristics of the claimed invention.

The terms "a," "an," and the singular forms of words shall be taken to include the plural form of the same words, such that the terms mean that one or more of something is provided. For example, the phrase "an apparatus having a drive motor" should be read to describe an apparatus having one or more drive motors. The term "one" or "single" shall be used to indicate that one and only one of something is intended. Similarly, other specific integer values, such as "two," are used when a specific number of things is intended.

The terms "preferably," "preferred," "prefer," "optionally," "may," and similar terms are used in the specification to indicate that an item, condition or step being referred to is an optional (not required) feature of the invention.

While a preferred form of the present invention has been described herein, various modifications of the apparatus and method of the invention may be made without departing from the spirit and scope of the invention, which is more fully defined in the following claims.

The foregoing, as well as other, objects, features, and advantages of the present invention will be more fully appreciated and understood by reference to the following drawings, specification and claims.

DETAILED DESCRIPTION

Figure 1:
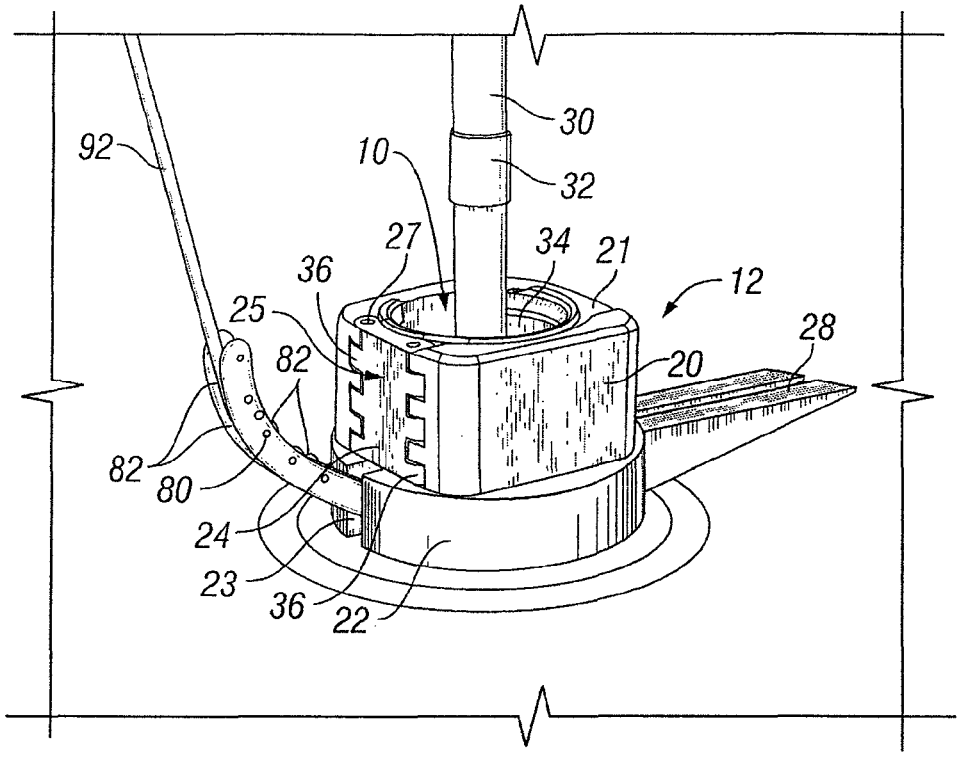
FIG. 1 is a perspective view of one embodiment of a spider of the present invention in its position aligned with the borehole and engaging the pipe string with a control line guide in its retracted position with at least a portion of the control line guide beneath the bottom of the slips within the spider.

FIG. 1 is a perspective view of one embodiment of a spider 12 of the present invention comprising a tapered bowl 20 in its position aligned with the borehole 10 and engaging the pipe string 30 just below a pipe joint 32. The control line guide 80 is shown in its retracted position with at least a portion of the control line guide beneath the top surface 21 of the tapered bowl. The tapered bowl 20 comprises a door 24 that is openable to receive the pipe string 30 into the bore 34 of the tapered bowl 20. The door 24 shown in FIG. 1 is a conventional door having hinged connections to the tapered bowl at each end. A rotary adapter 22 supports the spider and accommodates the control line guide 80 in a slot 23 when the control line guide is in its retracted position. Adjacent to the spider 12 is a runway 28 releasably coupled to the rotary adapter 22. The runway is adapted for receiving and supporting the tapered bowl 20 when it is moved laterally away from the pipe string 30 to a remote position (see FIG. 2). The tapered bowl 20 receives and cooperates with a set of slips (not shown in FIG. 1) to wedge between the pipe string and the tapered surface of the bowl to grip and support the pipe string 30.

The control line guide 80 comprises a plurality of generally spaced-apart rollers 82, each having a generally horizontal axis of rotation, and each retained in a generally fixed relationship relative to the other rollers. The control line guide receives the control line 92 from, or surrenders the control line to, a spool (not shown). The control line 92 may be reeved over sheaves (not shown) to strategically direct the control line to the control line guide from above or, when the control line is being removed from the borehole, to strategically direct the control line to a spool (not shown) for storage.

Figure 2:
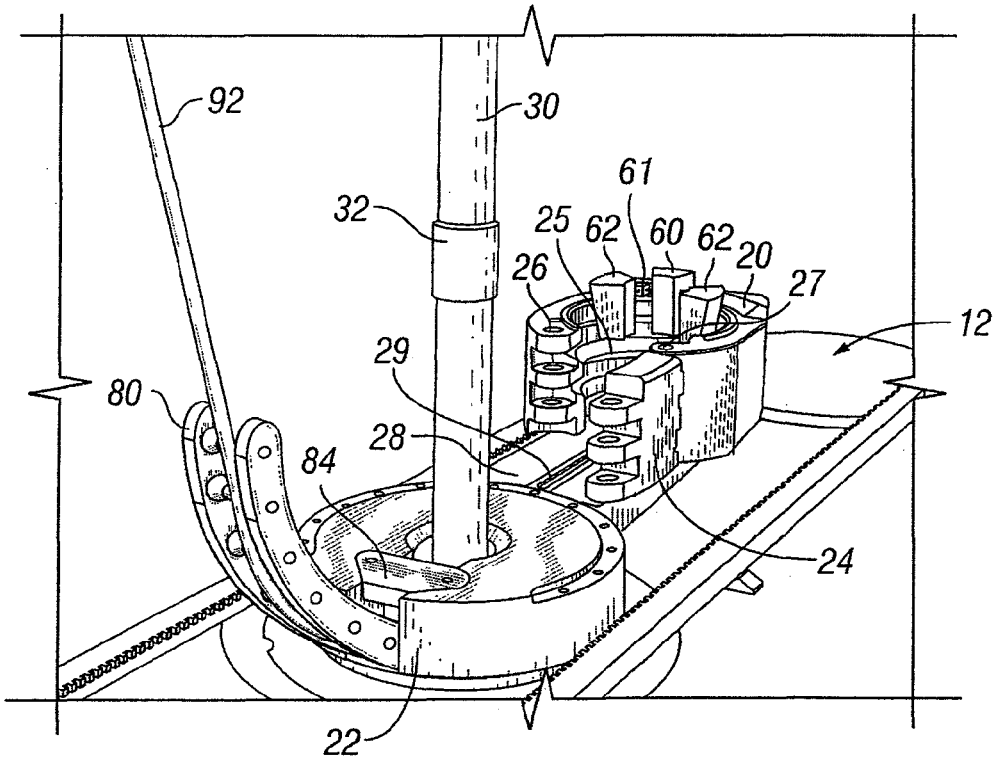
FIG. 2 is a perspective view of the embodiment shown in FIG. 1 with the slips disengaged from the pipe string but remaining within the tapered bowl of the spider, and the side door of the tapered bowl opened to open a slot in the side of the tapered bowl to permit the movement of the tapered bowl laterally away from the pipe string along a runway.

The tapered bowl 20 comprises a door 24 received to close a slot 25. The door 24 is secured to the tapered bowl 20 with a pair of hinges 36 adapted for receiving a pair of pins 27. Removal of either closure pin 27 enables the door to hingedly swing open for removal of the tapered bowl 20 from its aligned position with the borehole (as shown in FIG. 2). Removal of the pin requires that the weight of the pipe string first be transferred to the elevator (not shown).

A runway 28 is positioned adjacent to the rotary adapter 22 for slidably or rollably supporting the tapered bowl when the door 24 is opened and the tapered bowl is moved laterally away from the pipe string 30 (as shown in FIG. 2). The runway is angularly positionable about the rotary adapter 22 so that the runway may align with the movement of the tapered bowl that will be opposite the door 24, but may also allow movement of the tapered bowl 20 about the rotary adapter 22 while the tapered bowl is stored in its remote position on the runway.

FIG. 2 is a perspective view of the embodiment of the present invention shown in FIG. 1 with slips 60, 62 removed from the tapered bowl 20 of the spider 12 and the door 24 opened at one hinge 26 to open slot 25 of the tapered bowl 20 to facilitate movement of the tapered bowl laterally away from the pipe string 30 to its remote position on the runway 28. The slips shown in FIG. 2 are a set of three slips consisting of one manipulated slip 60 hinged through hinges 61 disposed on opposing sides of slip 60 to following slips 62. The runway may contain a slot 29 through which a mechanism (not shown) may engage and pull or push the tapered bowl 20 along the runway 28. Lateral movement of the tapered bowl 20 away from the pipe string 30 to its remote position on the runway 28 reveals the lift plate 84. The lift plate 84 is adapted for supporting the control line guide 80, for covering the slot in the rotary adapter (see FIG. 1, element 23) in the rotary adapter 22 and for evenly distributing the load from the tapered bowl 20 to the rotary adapter 22 when the tapered bowl is in its position aligned with the borehole 10 (see FIG. 1).

Figure 3:
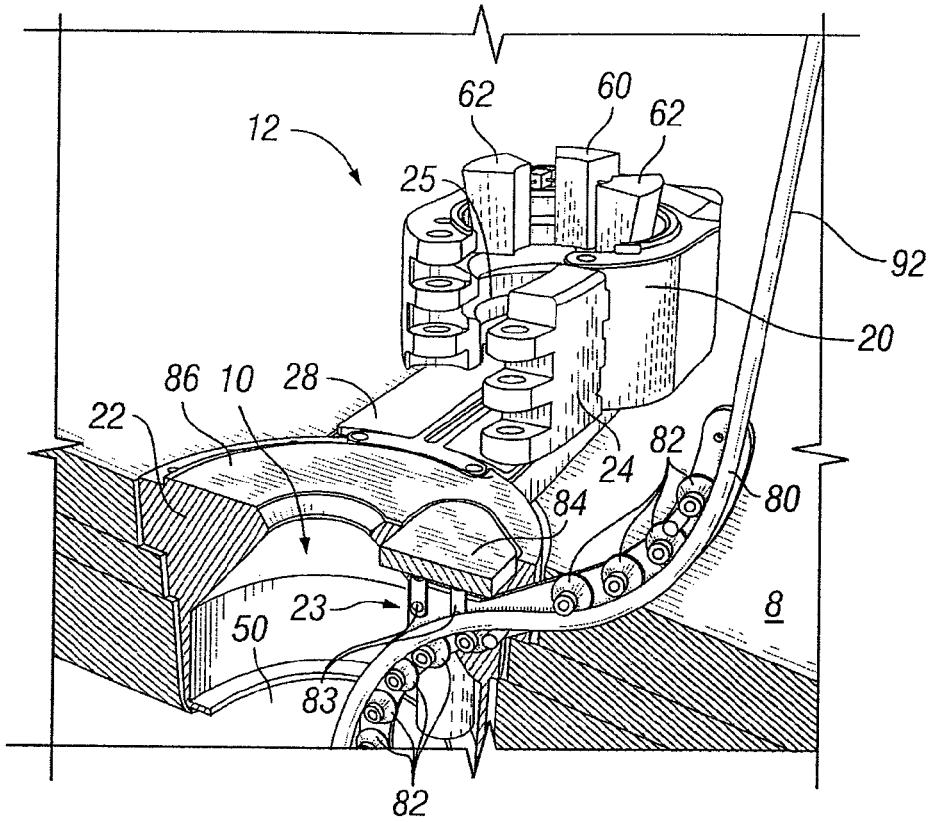
FIG. 3 is a partial cross-section perspective view of one embodiment of the present invention showing the cross-section of the rotary adapter for supporting the spider within the rig floor and for accommodating the control line guide in its retracted position within the slot of the rotary adapter. The tapered bowl is shown in its remote position laterally removed from the pipe string along a supporting runway.

FIG. 3 is a partial cross-section perspective view of the embodiment shown in FIG. 2 showing the cross-section of the rotary adapter 22 for supporting the spider 12 engaging the rig floor 8 and for accommodating the control line guide in its retracted position within the slot of the rotary adapter. The tapered bowl 20 is shown supported in its remote position on the runway 28. The slips 60, 62 are shown raised from their position within the tapered bowl to facilitate removal of the tapered bowl from its position aligned with the borehole 10 on the rotary adapter 22. The slot 23 of the rotary adapter accommodates the control line guide 80 in its retracted position. Guide supports 83 couple the control line guide 80 to the lift plate 83. This figure shows how control line 92 is reeved through the control line guide 80 which is shown in section view. In the embodiment of the control line guide shown in FIG. 3, the control line 92 rolls on the radially outwardly and bottom portions of the top set of rollers 82 located above and radially outwardly from the guide support 83, then the control line 92 reeves between the upper and lower sets of rollers adjacent to the guide supports 83, and then it rolls on the radially inwardly and upwardly disposed portions of the lower set of rollers 82, from which it extends along the length of a portion of the pipe string 30 and down into the borehole 10.

Figure 4:
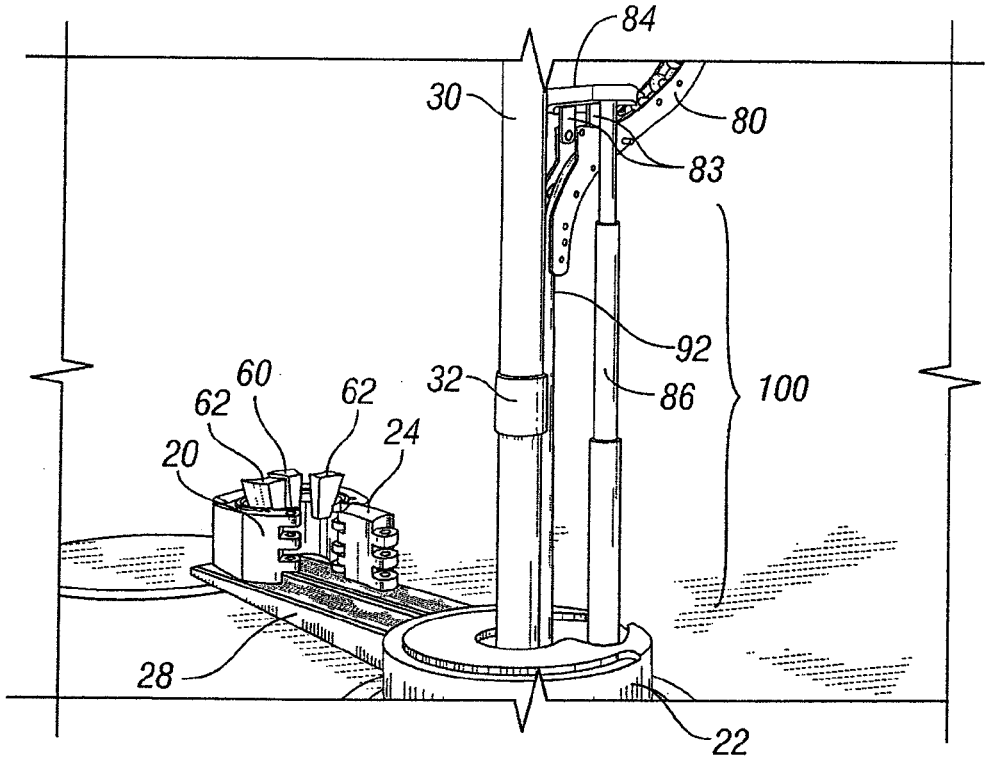
FIG. 4 is a perspective view of one embodiment of the present invention with the tapered bowl of the spider in its remote position and the control line guide elevated to its raised position using a hydraulically telescoping jack to raise the control line guide and position a portion of the control line along a portion of the pipe string to create a clamping zone.

FIG. 4 is a perspective view of the embodiment of the present invention shown in FIGS. 2 and 3 with the tapered bowl 20 with the side door 24 opened to permit removal of the tapered bowl to its remote position on the runway 28. The slips 60, 62 are shown remaining within the tapered bowl but raised from their engaged and seated position within the tapered bowl to permit removal of the pipe string. The control line guide 80 is raised to its raised position using a hydraulically telescoping jack 86 that is coupled at its traveling end to the lift plate 84. The lift plate is, in turn, coupled to the guide supports 83 that pivotally support the control line guide 80 there under. A portion of the control line 92 is shown positioned by the raising of the control line guide 80 along the length of the pipe string 30 to create a clamping zone 100 beneath the control line guide and above the rotary adapter 22.

Figure 5:
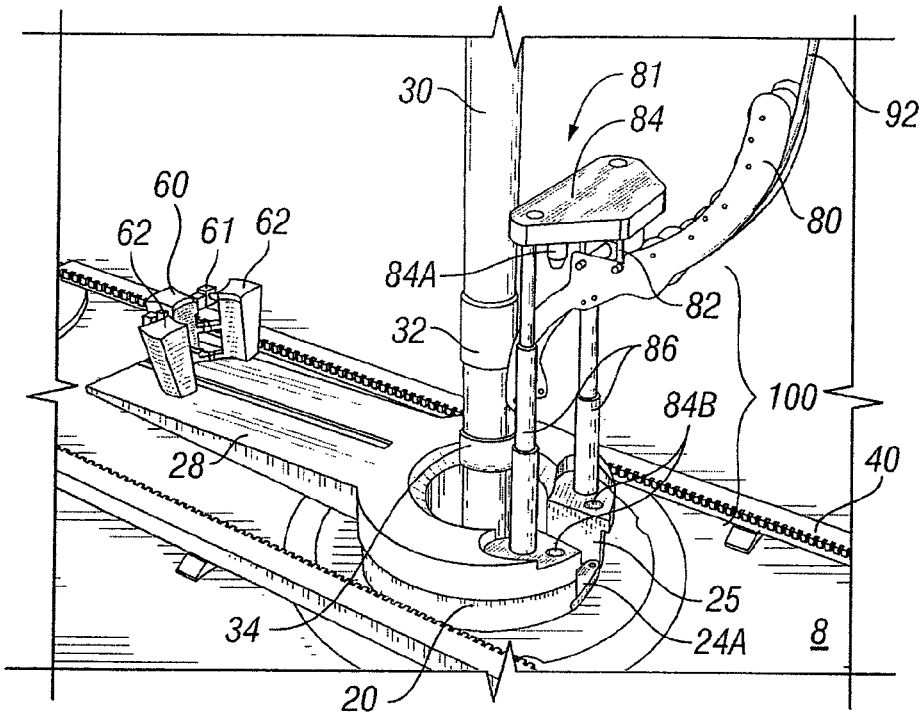
FIG. 5 is a perspective view of an embodiment of the present invention with the slips laterally removed from the tapered bowl along a runway and a plug-in door and control line guide coupled to a hydraulically telescoping jack. The tapered bowl has a radial slot for receiving the plug-in door, and through which the control line guide reciprocates between its retracted and its raised position.

FIG. 5 is a perspective view of alternate embodiment of the present invention with the tapered bowl 20 of the spider having a slot 25 adapted to receive a plug-in door 81. The plug-in door comprises the lift plate 84 and the downwardly protruding inserts 84A that are received into vertically aligned receptacles 84B disposed on each side of the slot 25 in the tapered bowl 20. In this embodiment, the tapered bowl 20 is shown recessed into the rig floor 8, and the lower portion of the slot 25 of the tapered bowl 20 is closed using a truncated side door 24A which, when closed, is disposed in the slot 25 generally below the received position (see FIG. 6) of the plug-in door 81.

Figure 6:
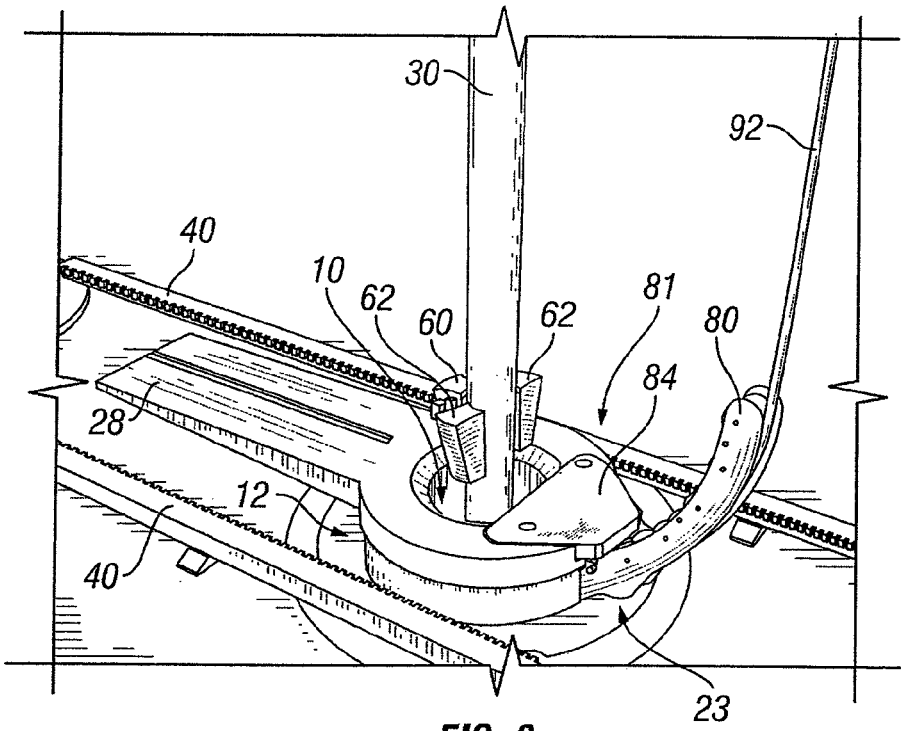
FIG. 6 is a perspective view of the embodiment shown in FIG. 5 after the slips have been partially returned to their engaged position within the tapered bowl and the control line guide and the plug-in door both restored to their retracted and closed positions, respectively, with at least a portion of the control line guide beneath the top surface of the tapered bowl.

The plug-in door 81 is coupled to the traveling end of the hydraulically powered telescoping jack legs 86, and the control line guide 80 is pivotally supported beneath the lift plate 84 using support links 82. The inserts 84A of the plug-in door are vertically aligned with the receptacles 84B in the tapered bowl so that the inserts are received into the receptacles upon retraction of the hydraulically telescoping jack legs 86 and lowering of the plug-in door 81 and the control line guide 80. FIG. 6 is a perspective view of the embodiment shown in FIG. 5 with the control line guide 80 restored to its retracted position with at least a portion of the control line guide beneath the top surface of the tapered bowl 20. The slips 60, 62 are shown restored to the tapered bowl 20 aligned with the borehole but remaining above their engaged position within the tapered bowl 20.

As shown in FIG. 6, the inserts 84A of the plug-in door 81 are received into the receptacles 84B, the control line guide is received into the slot 25 above the truncated side door 24A and below the seated plug-in door 81. The arrangement of the plug-in door 81 and the truncated side door 24A, with a space there between for accommodating the control line guide 80, provides for convenient removal and reintroduction of the plug-in door 81 from and to the tapered bowl 20 for unseating and reseating, respectively, with reciprocating motion of the control line guide as controlled by the jack 86. Removal of the plug-in door 81 upon raising of the control line guide 80 from the slot 25 significantly decreases the load bearing capacity of the tapered bowl even though the truncated side door 24A remains in position to close the lower portion of the slot. The load bearing capacity of the tapered bowl 20 is significantly increased when the plug-in door 81 is slidably vertically received into the slot 25. The plug-in door provides enhanced hoop strength to the tapered bowl to resist the spreading force on the bowl when the slips engage and support the pipe string.

The slips 60, 62 are adapted for being removed from their engaged position within the tapered bowl 20 to a remote position as shown in FIG. 5. Like the tapered bowl of FIGS. 3 and 4, the slips can be adapted for powered movement to and from the borehole along the runway. The tapered bowl 20 of the embodiment shown in FIGS. 5 and 6 is adapted for remaining stationary in its position aligned with the borehole when the control line guide 80 and plug-in door 81 are unseated and raised above the slot 25 using the telescoping jack legs 86 to create a clamping zone 100. Machines or rig personnel can access the portion of the pipe string 30 and control line 92 within the clamping zone shown in FIG. 5 to secure the control line to the pipe string using a clamp 34.

After the elevator (not shown) is used to lower the pipe string and the control line secured thereto into the borehole as shown in FIG. 6, retraction of the jacks (see FIG. 5, element 86) returns the control line guide 80 and the plug-in door 81 to their retracted and received positions, respectively, after one or more clamps are used to secure the control line to the pipe string in the clamping zone 100.

Figure 7:
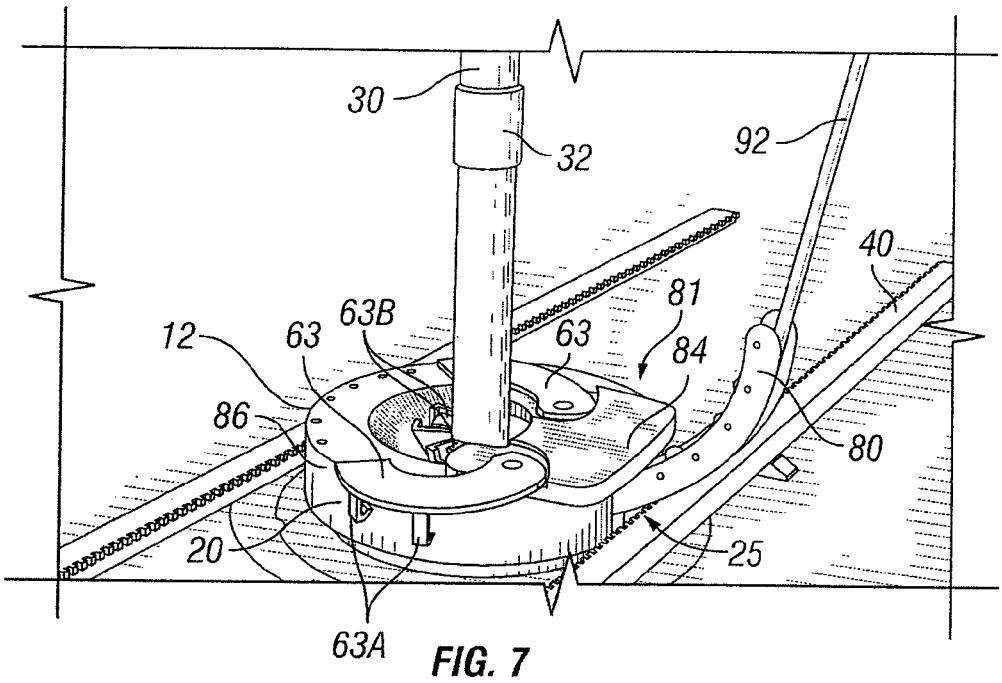
FIG. 7 is a perspective view of an embodiment of the present invention with the tapered bowl having a plug-in door received into a slot through which the control line guide passes when it is raised from its retracted position, and also having a pair of opposed hangers for pivotably engaging and latching to the slips. The control line guide is coupled to the plug-in door that also supports the pivoting hangers so that the slips can be raised above the tapered bowl using the same jack that raises the control line guide and the plug-in door.

FIG. 7 is a perspective view of an alternate embodiment of the present invention with the tapered bowl 20 having a slot 25 for receiving the plug-in door 81 and the control line guide 80 in their seated and retracted positions, respectively. The control line guide 80 is shown fitted with a pair of pivoting slip hangers 63 for rotating and engaging the slips 60, 62. The slip hangers 63 each have one or more latches 63A for engaging one or more lift ears 63B on the slips 60, 62. Rotating the slip hangers 63 to engage the lift ears 63B with the latches 63A couples the slips to the lift plate 84 so that the slips can be lifted from the tapered bowl using the hydraulically telescoping jacks legs 86 (see FIG. 5) used to raise the plug-in door 81 and the control line guide 80 from the slot 25.

Figure 8:
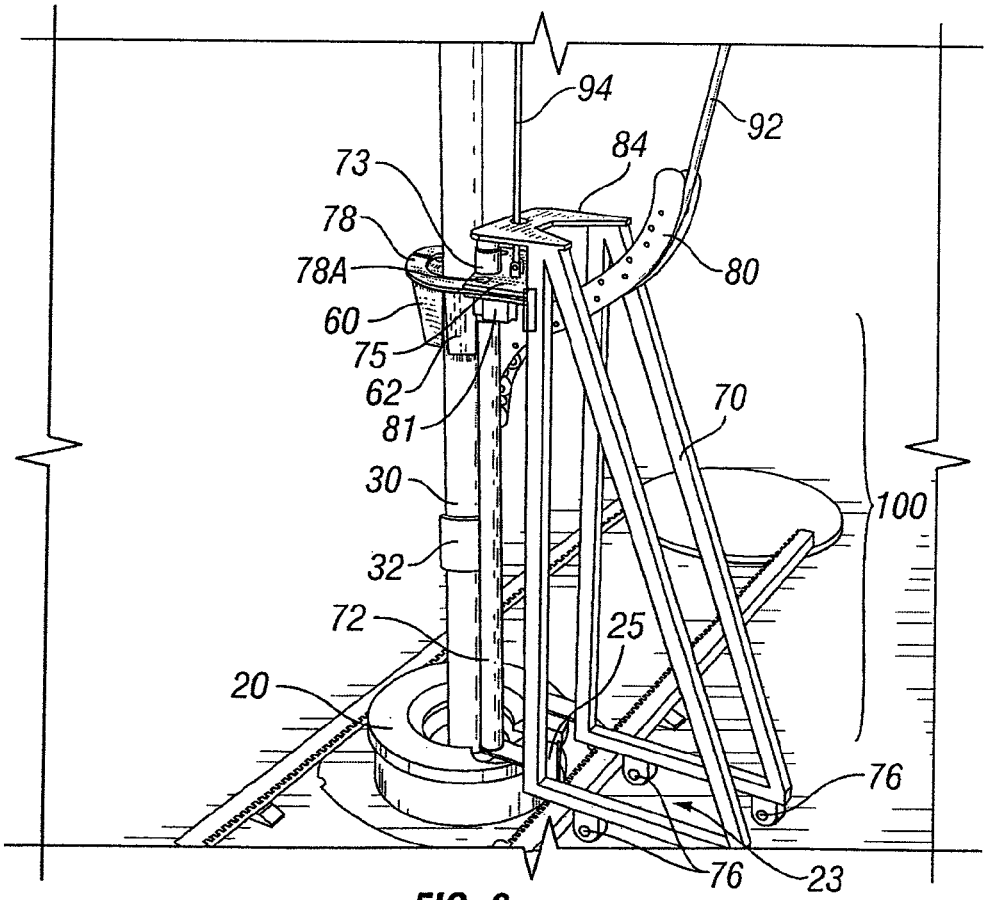
FIG. 8 is a perspective view of the embodiment of the present invention having an alternative apparatus for raising the control line guide, plug-in door and the slips along a portion of the pipe string above the tapered bowl. The control line guide and plug-in door are raised using a winch cable coupled to a lift plate, and the path of the control line guide, plug-in door and slips conforms to the pathway dictated by the structural guide positioned adjacent to the pipe string prior to the onset of running the control line.

FIG. 8 is a perspective view of an alternate embodiment of the present invention having an alternative apparatus for raising the plug-in door 81 and the control line guide 80 from the slot of the tapered bowl 20 to create a clamping zone 100. Like the embodiments shown in FIGS. 5-7, the embodiment shown in FIG. 8 comprises a tapered bowl 20 having a slot 25 for receiving the plug-in door 81 and the control line guide 80 when the plug-in door and the control line guide are in their seated and retracted positions, respectively. FIG. 8 shows an apparatus using a winch instead of a jack to raise the plug-in door, control line guide and slips from the tapered bowl to an elevated position to establish a clamping zone. The sliding lift plate 75 is coupled to the lift cable 94 and pivotally supports a pair of slip hangers 78 for rotatably engaging the manipulated slip 60 to facilitate lifting the slips 60, 62 from the tapered bowl 20. The lift cable 94 is secured to a winch (not shown) and can be reeled in to raise and unreeled to lower the sliding lift plate 75. A pair of opposed hangers 78 are coupled to the lift plate at a pivot 78A and pivot to engage the manipulated slip 60 to couple the slips 60, 62 to the lift plate.

The pathway for raising the plug-in door 81, the control line guide 80 and the slips 60, 62 from the tapered bowl 20 is determined by the A-frame 70. The A-frame 70 comprises a pair of generally vertical rails 72, each slidably receiving a pair of sleeves 73 each coupled to the lift plate 75. The lift plate 75 is coupled to a winch cable 94 that raises the lift plate 75, the control line guide 80 and the slips 60, 62 to a raised position. Upon actuation of the winch (not shown), the sleeves 73 slide along the vertical length of the rails 72, and the vertical path of the plug-in door 81 and control line guide 80 conforms to the pathway provided by the sliding movement of the sleeves 73 on the rails 72 positioned adjacent to the pipe string 30. After the winch is actuated to raise the plug-in door and control line guide to their raised position to create the clamping zone 100, clamps (not shown) may be applied to secure the control line 92 to the pipe string 30. After the pipe string and control line are lowered into the borehole, the winch rotation is reversed to lower the control line guide back to its retracted position through the slot of the tapered bowl. The A-frame 70 may be rollably removable from the vicinity of the borehole on a set of wheels 76 when control line is not being run into the well.

Figure 9:
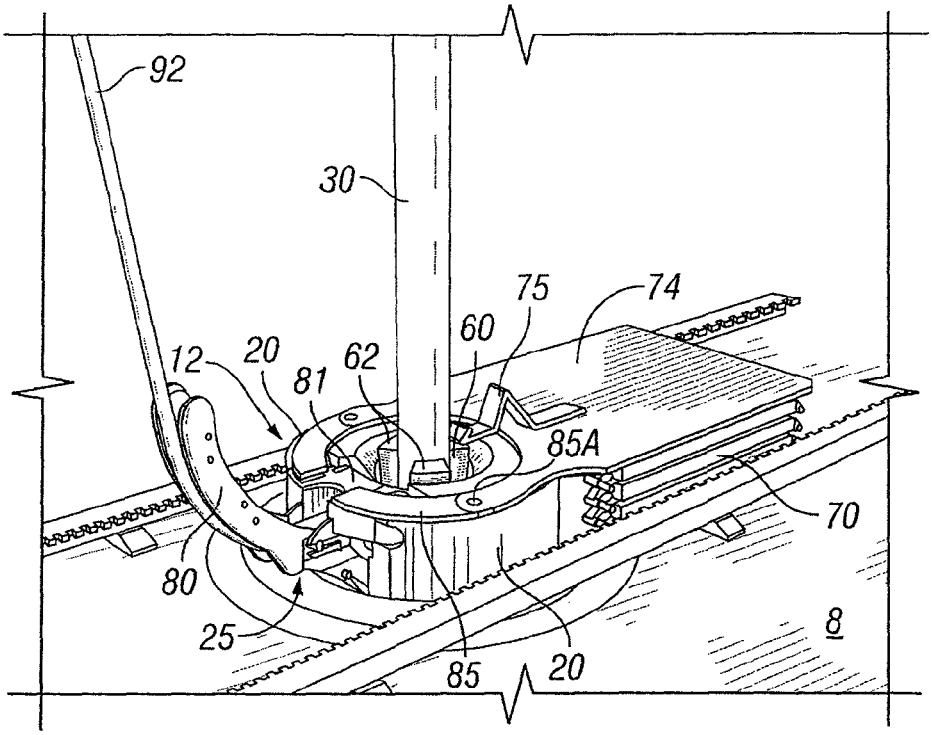
FIG. 9 is a perspective view of an embodiment of the present invention having an alternative apparatus for raising the control line guide, plug-in door and slips above the tapered bowl. The control line guide is coupled to a plate that is raised using a scissor-lift jack. The scissor-lift jacks supports a latch that couples to the slips to raise the slips from the tapered bowl, and the scissor-lift jack supports an opposed pair of opposed supports that pivot to engage and support the control line guide and plug-in door.

FIG. 9 is a perspective view of an alternative embodiment of the present invention having an alternative apparatus for raising the plug-in door, control line guide 80 and slips 60, 62 to their raised position above the tapered bowl 20. Like the embodiments shown in FIGS. 5-8, this embodiment comprises a tapered bowl 20 with a slot 25 for receiving the control line guide 80 and a plug-in door 81. The slips 60, 62 are adapted for being repetitively removed from the tapered bowl 20 each time the control line guide 80 and the plug-in door 81 are raised to create a clamping zone for securing a control line 92 to the pipe string 30.

FIG. 9 shows the control line guide 80, the plug-in door 81, and a scissor-lift jack 70 in the retracted position, with the control line guide 80 and the plug-in door 81 received within the slot 25 of the tapered bowl 20. The control line guide 80 and plug-in door 81 are raised using the scissor-lift jack 70. The scissor-lift jack 70 supports a lift plate 74 that is coupled through a slip bracket 75 to the slips 60, 62 to support and to vertically raise the slips from the tapered bowl 20 as the control line guide 80 and the plug-in door 81 are raised using the scissor-lift jack 70.

Figure 10:
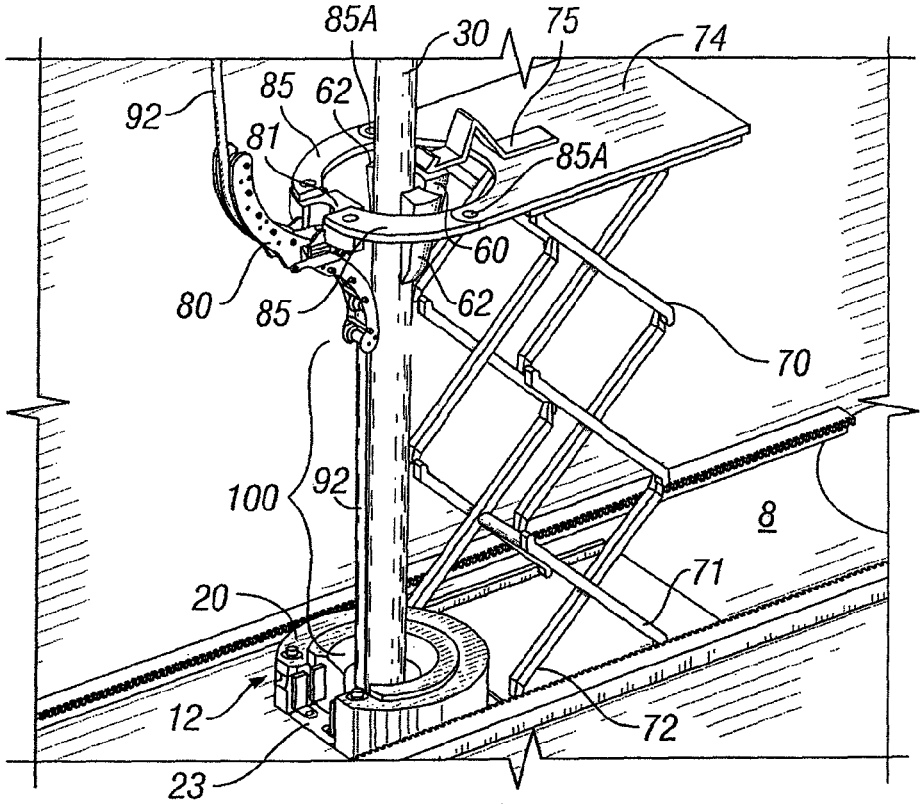
FIG. 10 is a perspective view of the embodiment of FIG. 9 with the slips, plug-in door and control line guide elevated to the raised position to align a portion of the control line along a portion of the pipe string to create a clamping zone.

FIG. 10 shows the embodiment of FIG. 9 with the control line guide 80, the plug-in door 81 and the slips 60, 62 raised above the tapered bowl 20 using the scissor-lift jack 70. The drivers for operating the scissor-jack may be coupled to the scissor-jack from beneath the rig floor 8, and may include a hydraulic or pneumatic cylinder, a screw jack, or electric motor driver, so long as the driver is adapted for forcibly increasing (to raise) or decreasing (to lower) the distance between two adjacent sliding ends 72 of the scissor legs 71 of the scissor-lift.

A pair of opposing plug-in door supports 85 are coupled to and extend outwardly from lift plate 74 to pivotably engage and couple to the plug-in door 81 which supports the control line guide 80. The plug-in door supports 85 are rotatable about pivots 85A to permit the generally arcuate plug-in door supports to substantially surround the pipe string 30 and engage, support and raise the plug-in door 81 and the attached control line guide 80 to position a portion of the control line 92 along the pipe string in the clamping zone 100.

Figure 11A:
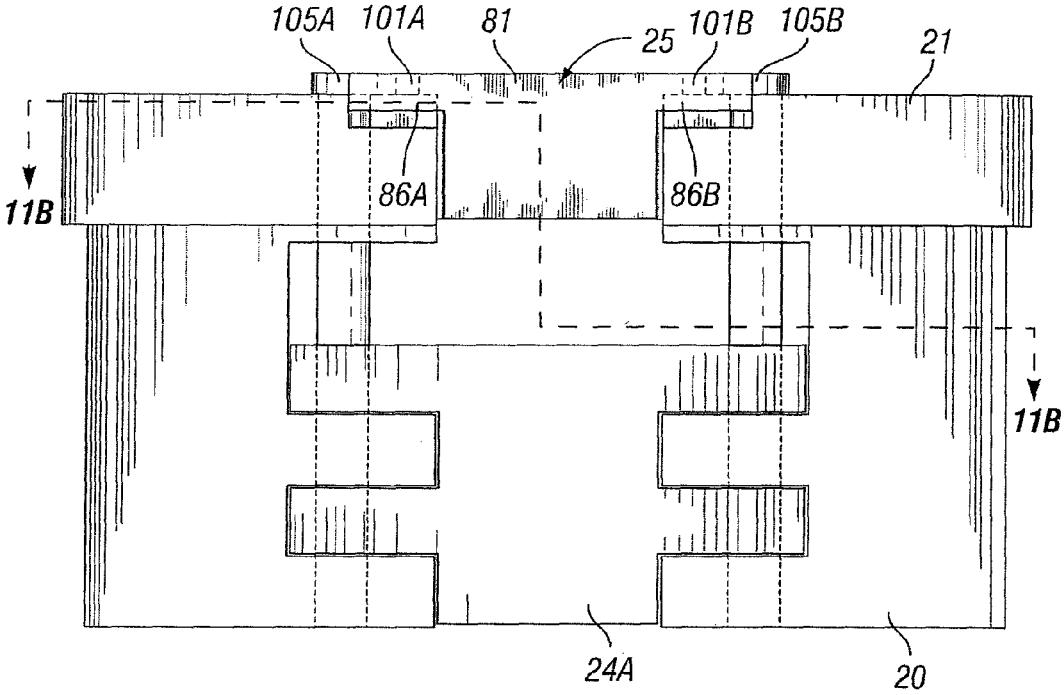
FIG. 11A is a side view of the embodiment of the present invention having a truncated interdigitated door below a space for penetration of the control line guide below a plug-in door received into the tapered bowl of a spider.
Figure 11B:
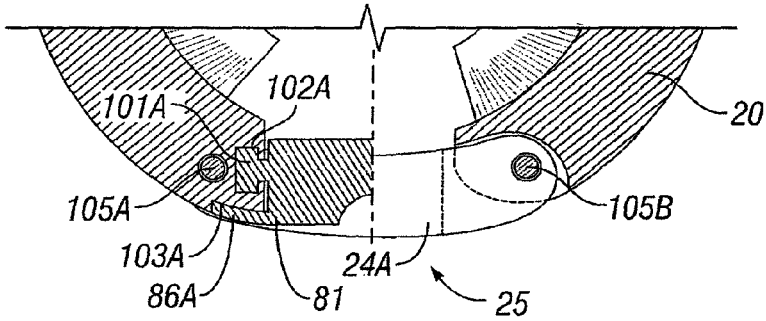
FIG. 11B is a top offset cross-section view of the embodiment of the present invention shown in FIG. 11A showing the plug-in door received in an interlocking fashion into the tapered bowl to close the slot, and the top of the truncated interdigitated door below the plug-in door.

FIGS. 11A, 11B, 12 and 13 show more detail relating to one embodiment of the plug-in door 81 used with the embodiments shown in FIGS. 8-10. FIG. 11A shows a side view of the embodiment of the present invention having a truncated interdigitated door 24A to close the lower portion of the slot 25 in the tapered bowl 20 vertically below a space for accommodating the control line guide, that space being vertically below a plug-in door 81 received into the upper portion of the slot 25 of the tapered bowl 20 to close the slot. FIG. 11B is a top view of the slot of the embodiment of the tapered bowl of the present invention shown in FIG. 11A. The tapered bowl 20 has a slot 25 adapted for receiving the plug-in door 81 (see FIG. 12). The slot 25 extends only a portion of the way downwardly from the top surface 21 of the tapered bowl 20 and is adapted to receive the plug-in door and the control line guide (not shown) so that, when the plug-in door is slidably received into the slot 25 to form a continuous wall perimeter around the top portion of the tapered bowl 20, the control line 92 and the control line guide 80 through which the control line 92 is reeved penetrates the wall of the tapered bowl through a portion of the slot that remains beneath the received plug-in door.

The tapered bowl 20 further comprises a pair of generally opposed T-slots 102A and 102B disposed on opposite sides of the slot 25 for receiving a pair of generally T-shaped keys (see FIG. 12) to circumferentially interlock the plug-in door. This structure provides enhanced hoop strength to the tapered bowl 20 when the plug-in door 81 is received. The tapered bowl may comprise a pair of opposed alignment recesses 103A and 103B disposed on opposing sides of slot 25 for receiving a pair of alignment wings 86A, 86B (see FIG. 12) on the plug-in door. The plug-in door is adapted for being received into a pair of slots 105A and 105B that are secured to the tapered bowl on opposing sides of the slot 25. This structure distributes the load across the plug-in door when the tapered bowl receives the slips to engage and support the pipe string.

The slot 25 that receives the plug-in door (see FIG. 12) and the control line guide 80 (see FIG. 12) also receives a truncated side door 24A to close the lower portion of the tapered bowl. The truncated side door 24A is a conventional hinged door for opening to permit removal of the tapered bowl to its remote position away from the pipe string (not shown).

Figure 12:
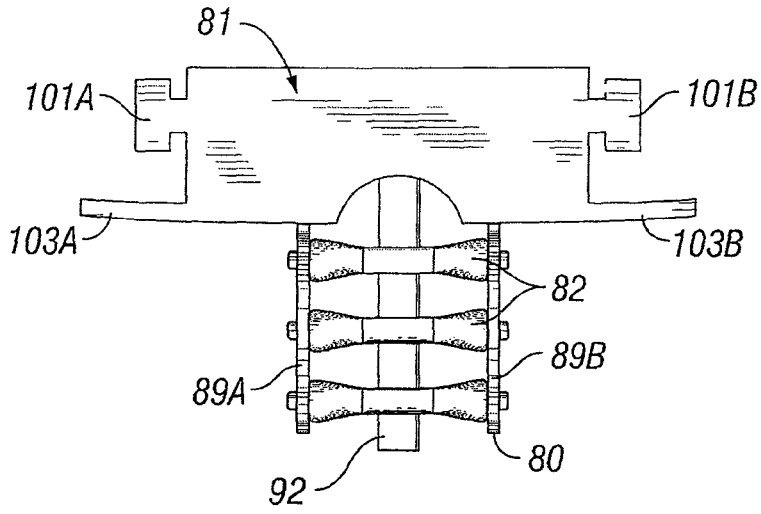
FIG. 12 is a top view of a plug-in door that is adapted for being received into the tapered bowl shown in FIGS. 11A and 11B. The plug-in door is coupled to and supports the control line guide. A control line is shown reeved through the control line guide.

FIG. 12 is a top view of one embodiment of the plug-in door 81 and the control line guide 80 adapted for being received into the slot 25 of the tapered bowl 20 of FIGS. 11A and 11B. The plug-in door 81 is coupled to the control line guide 80 through a pair of guide supports 83 (see FIG. 4). The plug-in door 81 comprises a pair of generally opposed T-shaped keys 101A and 101B for being received within the T-slots 102A and 102B (see FIG. 11B) to interlock the plug-in door into the tapered bowl. The T-shaped keys are adapted for being slidably vertically received into the T-shaped slots of the tapered bowl to provide enhanced hoop strength to the top portion of the tapered bowl when the slips are received into the bore of the tapered bowl to engage and support a pipe string. Similarly, the generally inwardly curved alignment wings 86A, 86B are received within the alignment recesses 103A, 103B of the tapered bowl (see FIG. 11B).

A variety of interlocking configurations can be utilized for slidably and vertically receiving the plug-in door 81 to circumferentially interlock with the tapered bowl 20 to provide enhanced hoop strength to the tapered bowl. The T-slotted plug-in door 81 shown in FIG. 12 and the downwardly disposed insert plug-in door shown in FIG. 5 are two examples of such doors, but any door that is slidably and vertically received into a mating position with the tapered bowl is within the scope of this invention.

Figure 13:
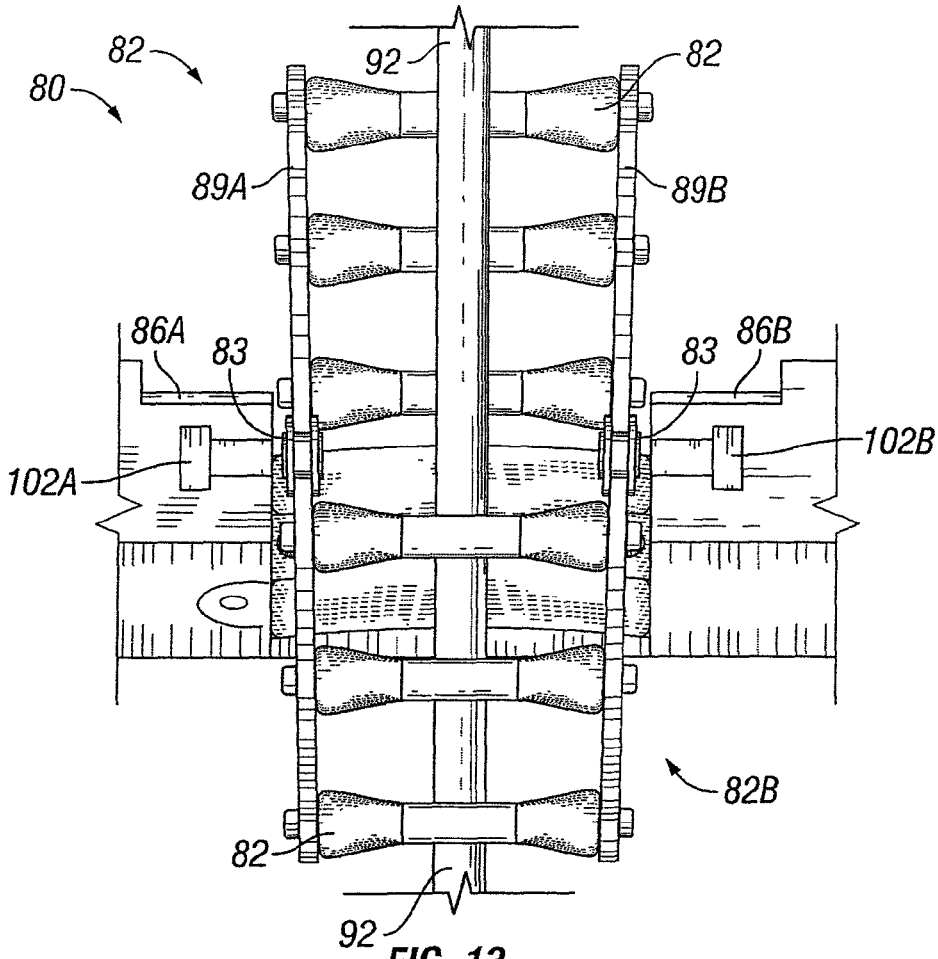
FIG. 13 is a front elevation view of an embodiment of a plug-in door and control line guide of the present invention having a control line reeved through the control line guide.

As shown in FIGS. 12 and 13, the control line 92 is reeved through the rollers 82 of the control line guide 80 as shown in FIG. 12, that is, the control line 92 rides generally along the radially outwardly and downwardly disposed portions of the rollers 82 that lie radially outside the wall of the tapered bowl when the control line guide is received within the slot 25 of the tapered bowl. After passing between the roller supports 89A and 89B, the control line 92 rides generally along the radially inwardly and upwardly disposed portions of the rollers 82 that lie radially within the wall of the tapered bowl 80. This relationship between the control line 92 and the rollers 82 is also shown in FIG. 13, a side frontal view of the plug-in door 81 and the control line guide 80. FIG. 13 shows the rollers 82 divided into a top set 82A and a bottom set 82B, the top set for contacting the control line 92 generally along the radially outwardly and downwardly disposed portions of the rollers 82 that lie radially outside the wall of the tapered bowl, and the bottom set 82B for contacting the control line 92 generally along the radially inwardly and upwardly disposed portions of the rollers 82 that lie radially within the wall of the tapered bowl 80.

While a preferred form of the present invention has been described herein, various modifications of the apparatus and method of the invention may be made without departing from the spirit and scope of the invention, which is more fully defined in the following claims.

We claim:

1. An apparatus to attach a control line to a tubular member, the apparatus comprising:

a bowl;

a plurality of slip assemblies movably disposed within the bowl of the apparatus;

a control line passage formed within the apparatus and outside of a travel path of the plurality of slip assemblies; and a control line guide disposed within the apparatus and configured to secure the control line;

wherein the apparatus is configured to move the control line into and out of the travel path of the plurality of slip assemblies; and wherein the control line passage is formed within the bowl.

2. The apparatus of claim 1, wherein the control line guide is movable.

3. The apparatus of claim 2, wherein the control line guide is movable between a retracted position and a raised position.

4. The apparatus of claim 3, wherein the control line guide is movable using a power source, and wherein the power source comprises at least one of hydraulic power, pneumatic power, mechanical power, and electrical power.

5. The apparatus of claim 1, further comprising a tapered surface formed within the apparatus, wherein the plurality of slip assemblies engage the tapered surface when moving within the apparatus.

6. The apparatus of claim 1, wherein the apparatus is disposed within a drilling rig floor.

7. The apparatus of claim 1, wherein the control line guide secures the control line from moving within the travel path of the plurality of slip assemblies.

8. The apparatus of claim 1, further comprising a position sensor operably coupled to and configured to measure a position of the control line guide.

9. The apparatus of claim 8, further comprising a controller operably coupled to and configured to control the position of the control line guide.

10. The apparatus of claim 1, further comprising a guide attached to a drilling rig and configured to receive the control line therein and direct the control line to the control line guide.

11. The apparatus of claim 10, wherein the guide comprises at least one of a sheave and a roller.

12. The apparatus of claim 1, wherein the control line guide is configured to move the control line between the control line passage and a position disposed adjacent to the tubular member.

13. An apparatus to attach a control line to a tubular member, the apparatus comprising:

a plurality of slip assemblies movably disposed within the apparatus;

a control line passage formed within the apparatus and outside of a travel path of the plurality of slip assemblies; and a control line guide disposed within the apparatus and configured to secure the control line;

wherein the apparatus is configured to move the control line into and out of the travel path of the plurality of slip assemblies; and wherein the control line guide is disposed adjacent to the control line passage and configured to secure the control line within the control line passage.

14. An apparatus to attach a control line to a tubular member, the apparatus comprising:

a plurality of slip assemblies movably disposed within the apparatus;

a control line passage formed within the apparatus and outside of a travel path of the plurality of slip assemblies; and a control line guide disposed within the apparatus and configured to secure the control line;

wherein the apparatus is configured to move the control line into and out of the travel path of the plurality of slip assemblies; and wherein the control line guide is disposed within the control line passage and configured to secure the control line within the control line passage.

15. A method to attach a control line to a tubular member, the method comprising:

attaching the control line to the tubular member;

lowering the tubular member with the control line attached thereto through a pipe engaging apparatus;

moving the control line into a control line passage formed within the pipe engaging apparatus, thereby moving the control line from within a travel path of a plurality of slip assemblies of the pipe engaging apparatus to out of the travel path of the plurality of slip assemblies;

securing the control line within the control line passage with a control line guide; and moving the plurality of slip assemblies of the pipe engaging apparatus towards the tubular member such that the plurality of slip assemblies engage the tubular member.

16. The method of claim 15, wherein a control line attachment mechanism is used to attach the control line to the tubular member.

17. The method of claim 16, wherein the control line attachment mechanism comprises a clamp.

18. The method of claim 15, further comprising:

connecting a second tubular member to the first tubular member; and supporting the first tubular member and the second tubular member with an elevator.

19. The method of claim 18, further comprising:

moving the plurality of slip assemblies away from the first tubular member such that the plurality of slip assemblies disengage the first tubular member;

releasing the control line from the control line guide;

moving the control line out of the control line passage of the pipe engaging apparatus, thereby moving the control line from out of the travel path of a plurality of slip assemblies to into the travel path of the plurality of slip assemblies; and attaching the control line to the second tubular member.

20. The method of claim 15, further comprising:

preventing moving the plurality of slip assemblies of the pipe engaging apparatus towards the tubular member if the control line is not secured within the control line passage.

21. The method of claim 15, further comprising moving the control line guide to secure the control line therein.

22. The method of claim 15, further comprising:

receiving the control line within a guide attached to a drilling rig; and directing the control line from the guide to the control line guide.

23. The method of claim 22, wherein the guide comprises at least one of a sheave and a roller.

24. The system of claim 23, wherein the pipe engaging apparatus comprises a plurality of slip assemblies movably disposed therein, and wherein the control line passage is formed outside of the travel path of the plurality of slip assemblies.

25. The system of claim 23, wherein the control line guide is configured to move the control line between the control line passage and a position disposed adjacent to the tubular member.

26. The method of claim 15, further comprising:

preventing moving the plurality of slip assemblies of the pipe engaging apparatus towards the tubular member if the control line is not secured within the control line passage.

27. A system to attach a control line to a tubular member, the system comprising:

a pipe engaging apparatus having an axis extending therethrough, the pipe engaging apparatus configured to engage an external surface of the tubular member such that the tubular member is supported by the pipe engaging apparatus;

a control line passage formed within the pipe engaging apparatus; and a control line guide disposed within the pipe engaging apparatus and configured to secure the control line within the control line passage.

28. A method to attach a control line to a tubular member, the method comprising:

moving a control line guide having the control line disposed therein from a first position to a second position, thereby moving the control line adjacent to the tubular member;

attaching the control line to the tubular member;

lowering the tubular member with the control line attached thereto through a pipe engaging apparatus;

moving the control line guide from the second position to the first position, thereby moving the control line into a control line passage formed within the pipe engaging apparatus, thereby moving the control line from within a travel path of a plurality of slip assemblies of the pipe engaging apparatus to out of the travel path of the plurality of slip assemblies; and moving the plurality of slip assemblies of the pipe engaging apparatus towards the tubular member such that the plurality of slip assemblies engage the tubular member.

29. The method of claim 28, wherein the first position for the control line guide comprises a retracted position, and wherein the second position for the control line guide comprises a raised position.

30. The method of claim 28, wherein moving the control line guide having the control line disposed therein from the first position to the second position comprises moving the control line with the control line guide into a clamping zone adjacent to the tubular member.

31. The method of claim 28, wherein moving the control line guide having the control line disposed therein from the first position to the second position comprises moving the control line from the control line passage of the pipe engaging apparatus to adjacent the tubular member.

32. The method of claim 28, further comprising:

connecting a second tubular member to the first tubular member; and supporting the first tubular member and the second tubular member with an elevator.

33. The method of claim 32, further comprising:

moving the plurality of slip assemblies away from the first tubular member such that the plurality of slip assemblies disengage the first tubular member;

moving the control line guide having the control line disposed therein from the first position to the second position, thereby moving the control line with the control line guide adjacent to the second tubular member; and attaching the control line to the second tubular member.

34. The method of claim 28, further comprising measuring a position of the control line guide with a position sensor operably coupled to the control line guide.

35. The method of claim 34, further comprising controlling the position of the control line guide with a controller operably coupled to the control line guide.

36. The method of claim 28, further comprising:

receiving the control line within a guide attached to a drilling rig; and directing the control line from the guide to the control line guide.

37. The method of claim 36, wherein the guide comprises at least one of a sheave and a roller.

38. The method of claim 28, further comprising:

preventing moving the plurality of slip assemblies of the pipe engaging apparatus towards the tubular member if the control line is not secured within the control line passage.

39. A method to attach a control line to a tubular member, the method comprising:

attaching the control line to the tubular member;

lowering the tubular member with the control line attached thereto through a pipe engaging apparatus;

moving the control line into a control line passage formed within the pipe engaging apparatus; and securing the control line within the control line passage with a control line guide, wherein the control line guide is disposed within the control line passage.

40. The method of claim 39, further comprising:

moving a plurality of slip assemblies of the pipe engaging apparatus towards the tubular member such that the plurality of slip assemblies engage the tubular member.

41. The method of claim 40, further comprising:

connecting a second tubular member to the first tubular member; and supporting the first tubular member and the second tubular member with an elevator.

42. The method of claim 41, further comprising:

moving the plurality of slip assemblies away from the first tubular member such that the plurality of slip assemblies disengage the first tubular member;

releasing the control line from the control line guide;

moving the control line out of the control line passage of the pipe engaging apparatus; and attaching the control line to the second tubular member.

43. The method of claim 39, further comprising measuring a position of the control line guide with a position sensor operably coupled to the control line guide.

* * * * *